US005801480A

United States Patent [19]

Kawaguchi et al.

[11] Patent Number: 5,801,480

[45] Date of Patent: Sep. 1, 1998

[54] COLOR CRT DEVICE WITH DEFLECTION YOKE

[75] Inventors: Takeo Kawaguchi; Hisanobu Tokunaga; Makoto Iwagami; Masumi Yuasa, all of Tokyo, Japan

[73] Assignees: Mitsubishi Denki Kabushiki Kaisha; Mitsubishi Electric Engineering Co., Ltd., both of Tokyo, Japan

[21] Appl. No.: 798,800

[22] Filed: Feb. 12, 1997

[30] Foreign Application Priority Data

Feb. 15, 1996 [JP] Japan ..... 8-027811

[51] Int. Cl.[6] ..... H01J 29/70

[52] U.S. Cl. ..... 313/440

[58] Field of Search ..... 313/440, 412, 313/414, 439; 315/15, 382; 335/213

[56] References Cited

U.S. PATENT DOCUMENTS 5,204,585 4/1993 Chen .
5,412,277 5/1995 Chen .

*Primary Examiner*—Sandra L. O'Shea
*Assistant Examiner*—Vip Patel

[57] ABSTRACT

A color CRT device having a cathode ray tube and a deflection coil. The cathode ray tube includes a panel provided with a phosphor surface which has a diagonal diameter of 45 cm or more and has an aspect ratio greater than 4/3 and an electron gun having a high-voltage electrode and a focusing electrode which is disposed in proximity to the high-voltage electrode across a gap. The deflection yoke includes a core which cross-section perpendicular to a tube axis of the cathode ray tube is approximately annular; a saddle type first deflection coil for deflecting in a horizontal direction an electron beam, and a toroidal type second deflection coil for deflecting in a vertical direction the electron beam. The color CRT device satisfies a following relational expression:

$$\frac{\sqrt{\frac{1}{1+K^2}}}{\frac{0.113\theta+0.563}{0.0075\theta-0.025}-2.5\sqrt{\frac{1}{1+K^2}}} \leq \frac{L}{D} \leq \frac{\sqrt{\frac{1}{1+K^2}}}{2.0-2.5\sqrt{\frac{1}{1+K^2}}}$$

where

L mm denotes a distance between a central position of the gap and an end surface of the core on a side of the stem, D mm denotes an inner diameter of the core on the side of the stem, θ denotes a maximum deflection angle of the cathode ray tube, and K denotes the aspect ratio.

4 Claims, 6 Drawing Sheets

COLOR CRT DEVICE WITH DEFLECTION YOKE

BACKGROUND OF THE INVENTION

The present invention relates to a color CRT device having a cathode ray tube (CRT) and a deflection yoke, and, in particular, to a structure for the purpose of reducing the overall length of the color CRT device without adversely affecting the focusing characteristics thereof.

FIGS. 5A and 5B are diagrams for the purpose of explaining the structure of a conventional color CRT device which relates to the present invention. Herein, FIG. 5A shows a horizontal partial cross-section taken along the line H—H of FIG. 5B, and FIG. 5B shows a front view of the color CRT device.

In FIGS. 5A and 5B, a reference numeral 1 designates a cathode ray tube, and 50 designates a deflection yoke which deflects the electron beam emitted by a electron gun 30. A reference numeral 2 designates a glass panel which is a structural element of the cathode ray tube 1 and is the portion upon which the image is displayed. A reference numeral 3 designates a nearly conical funnel which is a structural element of the cathode ray tube 1 and is connected to an end of the panel 2. A reference numeral 4 designates a cylindrical neck which is a structural element of the cathode ray tube 1 and is connected to the other end of the funnel 3. A reference numeral 5 designates a stem which is a structural element of the cathode ray tube 1 and is connected to the other end of the neck 4. The panel 2, the funnel 3, the neck 4 and the stem 5 form a vacuum vessel. Note that hereinafter an end nearest to the panel 2 along a tube axis of the cathode ray tube 1 is referred to as a front, and the other end nearest to the stem 5 is referred to as a rear. On an inner side of the panel 2 is provided a phosphor layer 10.

A reference numeral 20 designates a shadow mask which is a structural element of the cathode ray tube 1, is disposed on the rear side of the panel 2, faces the phosphor layer 10, and is positioned to maintain a specified distance from the phosphor layer 10. The shadow mask 20 is a thin metal plate which forms a specified convexly curved surface and is provided with a plurality number of regularly arranged apertures 21 which allow the passage of the electron beam. The shadow mask 20 is maintained in the specified shape and supported at the specified position on the inner surface of the panel 2 by means of supporting members which are not shown in the figures.

As shown in FIG. 5B, the panel 2, when seen from the front, is of nearly rectangular shape, and the region where the phosphor layer 10 is provided forms substantially rectangular shape which is nearly similar to the front shape of the panel 2. Here, for ease of explanation, the direction of the longer sides of this near rectangle will be referred to as a horizontal direction and the direction perpendicular thereto will be referred to as a vertical direction.

In accordance with common practice, a ratio of lengths of long and short sides of the phosphor layer 10 is referred to as an aspect ratio and represented by the symbol K (=A/B). Properly speaking, the aspect ratio K is the value obtained by dividing the length A of the diameter on the horizontal axis (i.e., long axis) by the length B of the diameter on the vertical axis (i.e., short axis).

A reference numeral 30 designates an electron gun, which is a structural element of the cathode ray tube 1, is positioned on the inner side of the neck 4, and includes unit electron guns 30R, 30G and 30B for generating electron beams corresponding to red, green and blue respectively.

The explanation here will be is in terms of an in-line electron gun, as one example of the electron gun 30. The unit electron guns 30R, 30G and 30B of the in-line electron gun 30 are disposed in a single plane in the horizontal direction. The electron beams emitted by the electron gun 30 (an example of which is designated in FIG. 5A by a reference numeral 100) is deflected in the desired direction by means of the deflection yoke 50, which is positioned in the vicinity of the point of contact between the neck 4 and the funnel 3, and directed toward the phosphor layer 10.

Since, the shadow mask 20 is positioned intermediately between the electron gun 30 and the phosphor layer 10, only that portion of the electron beam 100 directed toward the phosphor layer 10 which has passed through the aperture 21 reaches the phosphor material (which is not shown in the figures) that is a constituent of the phosphor layer 10, causing the phosphor material to emit light of the specified color.

FIG. 6 is a horizontal partial cross-section showing a color CRT device in which there is shown the structure of the electron gun 30 and the configuration according to which the electron gun 30 is mounted within the neck 4 of the color CRT device.

In addition to the unit electron guns 30B, 30G and 30R, the electron gun 30 has a heater 31, a cathode 32, a first grid 33, a second grid 34, a focusing electrode 35, a high-voltage electrode 36 and a cup-shaped member 39. A reference numeral 37 designates an insulating member, which may have, for example, a rod-like shape, and is made of a special glass. The focusing electrode 35 is positioned to the rear (that is to say, on the side of the stem 5) from the high-voltage electrode 36 across the gap 40.

A portion of each of the heater 31, the cathode 32, the first grid 33, the second grid 34, the focusing electrode 35 and the high-voltage electrode 36 is embedded in the insulating member 37, thereby maintaining the relative positions of these elements.

A cup-shaped member 39 is mounted to the tip of high-voltage electrode 36, and the tip of the cup-shaped member 39 is provided with a plurality of springs 38. Normally the cup-shaped member 39 is not provided for each of the unit electron guns 30B, 30G and 30R individually, but rather the three unit electron guns 30B, 30G and 30R are provided with the single cup-shaped member 39 in common.

The rear end of the electron gun 30 is supported by a plurality of stem leads 7, which are implanted in the stem 5 (depiction of the members providing the connection between the electron gun 30 and the stem leads 7 has been omitted in the figures).

A reference numeral 6 designates an inner conductive film 6, which is a structural element of the cathode ray tube 1 and is mounted to the inner surface of the funnel 3. The inner conductive film 6 is a thin electrically conductive coating film which normally includes graphite as its major constituent, and the high voltage which provides acceleration of the electron beam (hereinafter referred to as the anodic voltage) is applied to the inner conductive film 6, by means of the anode button (which is not shown in the figures) which is mounted so as to pass through the funnel 3. The inner conductive film 6 extends to the inner surface of the neck 4, and by this means the anodic voltage is supplied to the high-voltage electrode 36 via the springs 38 described above.

On the other hand, the anodic voltage is also supplied to the phosphor layer 10 (which is not shown in FIG. 6) via the same inner conductive film 6.

In the structure here under discussion, the inner conductive film 6, which is closer to the phosphor layer 10 than to the high-voltage electrode 36, is kept at the same voltage, so the space through which the electron beam scans is kept at the uniform electric potential.

The springs 38 are in contact with the inner conductive film 6 provided on the inner wall of the neck 4 to supply voltage to the electron gun 30, and at the same time perform the function of keeping the front end of the electron gun 30 itself stationary in the specified position within the neck 4. The anodic voltage applied to the high-voltage electrode 36 is generally 20 [kV] or above, and this is the highest voltage applied to the elements of the cathode ray tube 1. On the other hand, a voltage no more than one-third of that applied to the high-voltage electrode 36 is applied to the focusing electrode 35, normally via the stem lead 7.

The shape of the focusing electrode 35 is not confined to that shown in FIG. 6, but may frequently be such that a plurality of electrodes are arranged between the second grid 34 and the high-voltage electrode 36, and different voltages are applied to these electrodes respectively. It may also be the case that an anodic voltage which is the same as that of the high-voltage electrode 36 is applied to one or more electrodes.

Here, in the electron gun 30, the electron beam emitted from the electron gun 30 passes through the space which is surrounded by the inner conductive film 6 and is at the uniform electric potential, irrespective of the structure used. The focusing electrode 35 is positioned to the rear (that is to say on the side of the stem 5) from the high-voltage electrode 36. The term focusing electrode 35 shall refer to one of the electrodes to which is applied a voltage lower than the anodic voltage applied to the high-voltage electrode 36 and which is positioned closest to the high-voltage electrode 36.

In each of the unit electron guns 30R, 30G and 30B, each of the three electron beams leaving the cathode 32 expands as it proceeds toward the panel 2 so that its diameter reaches a maximum at the gap 40 between the focusing electrode 35 and the high-voltage electrode 36, and it is influenced by the focusing lens (which is not shown in the figures) formed by the electric potential distribution in the gap 40, so that it is focused thereafter to be a conical beam like a point of a pencil and proceeds toward the panel 2, forming a spot on the phosphor layer 10.

A reference numeral 50 designates a deflection yoke, and 51 designates a core, which is a structural element of the deflection yoke 50 and which is composed of ferromagnetic cylindrical ferrite. The cross-section of the core 51 in the direction perpendicular to the tube axis of the cathode ray tube 1 is approximately annular.

A reference numeral 52H designates a horizontal deflection coil, which is a structural element of the deflection yoke 50, which is wound so as to form an inner part of the deflection yoke 50, and which corresponds to a first deflection coil for generating the magnetic field which deflects the electron beam emitted by the electron gun 30 in the horizontal direction.

A reference numeral 52V designates a vertical deflection coil, which is a structural element of the deflection yoke 50, which is wound so as to form a part of the deflection yoke 50, and which corresponds to a second deflection coil for generating the magnetic field which deflects the electron beam emitted by electron gun 30 in the vertical direction.

The horizontal deflection coil 52H is of the type generally known as the saddle type, and is wound in such a way that the coil of the horizontal deflection coil 52H itself and the core 51 do not cross each other.

The vertical deflection coil 52V, on the other hand, is of the type generally known as the toroidal type, and is wound in such a way that the coil of the vertical deflection coil 52V itself and the core 51 cross each other.

In order, when displaying the image, to cause the electron beam 100 (shown in FIG. 5A) to describe a scanning line in the horizontal direction with the comparatively high repetitive frequency of approximately 15 [kHz] through 64 [kHz], a horizontal deflection field is generated by causing a sawtooth current to flow in the horizontal deflection coil 52H.

In order, on the other hand, when displaying the image, to cause the electron beam 100 (shown in FIG. 5A) to oscillate in the vertical direction with the comparatively low repetitive frequency of approximately 60 [Hz], a vertical deflection field is generated by causing a sawtooth current to flow in vertical deflection coil 52V.

To represent the ratings of a color CRT device, the terms maximum deflection angle, the horizontal deflection angle and the vertical deflection angle are frequently used.

In the phosphor layer 10 which is nearly rectangular, the term maximum deflection angle signifies the sum of the first deflection angle between the electron beam emitted from the unit electron gun 30G and impinging on the corner of the phosphor layer 10 and the center axis of the neck 4, and the second deflection angle between the electron beam emitted from the aforementioned unit electron gun 30G impinging on another corner which is diagonal to the aforementioned corner to and from the identical unit electron gun and the center axis of the neck 4. The description in this application is in terms of the unit electron gun 30G, but the same description applies to the other unit electron guns 30R and 30B.

Ordinarily, the design is such that the maximum deflection angle is two times the first deflection angle. The present invention relates to a color CRT device in which the diagonal diameter of the phosphor layer 10 (the distance between two diagonal corners which are oppositely positioned on approximately rectangular phosphor layer 10) is 45 [cm] or more. The maximum deflection angle for the color CRT device in which the diagonal diameter of the phosphor layer 10 is 45 [cm] or more is normally 90° through 110°.

Again, when the crossover point of the center axis of the neck 4 and approximately rectangular phosphor layer 10 is moved in a horizontal direction, taking the crossover points of the ends of approximately rectangular phosphor layer 10 as a first crossover point and a second crossover point, the term horizontal deflection angle signifies the sum of a first angle between the electron beam emitted from the unit electron gun 30G and impinging on the first crossover point and the center axis of the neck 4, and a second angle between the electron beam emitted from the unit electron gun 30G and impinging on the second crossover point and the center axis of the neck 4. Either the first angle or the second angle is known as the horizontal single-side deflection angle, and the design is normally such that two times the horizontal single-side deflection angle equals the horizontal deflection angle.

Again, when the crossover point of the center axis of the neck 4 and approximately rectangular phosphor layer 10 is moved in a vertical direction, taking the crossover points of the ends of approximately rectangular phosphor layer 10 as a third crossover point and a fourth crossover point, the term vertical deflection angle signifies the sum of a third angle between the electron beam emitted from the unit electron gun 30G and impinging on the third crossover point and the center axis of the neck 4, and a fourth angle between the electron beam emitted from the unit electron gun 30G and impinging on the fourth crossover point and the center axis of the neck 4. Either the third angle or the fourth angle is known as the vertical single-side deflection angle, and the design is normally such that two times the vertical single-side deflection angle equals the vertical deflection angle.

Following is an explanation of the positional relationship between the deflection yoke 50 and the electron gun 30.

Since both the deflection yoke 50 and the electron gun 30 normally have an undefined external shape with no clear positional reference point, the explanation of the positional relationship is given using a rear end surface 51A of the core 51 in case of the deflection yoke 50 and the gap 40 in the case of the electron gun 30, wherein is positioned the focusing lens (which is not shown in the figures) formed between the focusing electrode 35 and the high-voltage electrode 36.

According to conventional color CRT device, it has been necessary to provide a certain amount of distance (represented in FIG. 6 by L) between the rear end surface 51A of the core 51 and the center point of the gap 40 of the electron gun 30. This is because an appreciable part of the magnetic field generated by the deflection yoke 50 appears in the form of a leakage flux toward the rear of the rear end surface 51A, so that, as a result of this leakage flux, the electron beam is subjected to a minute deflection, known as a pre-deflection before reaching the gap 40 which forms the focusing lens (which is not shown in the figures).

When the electron beam is subjected to such a pre-deflection, an aberration (defocusing) is produced, such that the electron beam does not pass through the desired position in the vicinity of the gap 40. Therefore, the distance L is particularly important when the three unit electron guns 30B, 30G and 30R of the electron gun 30 are in a horizontal in-line arrangement (i.e., when the electron gun 30 is in-line type).

In the in-line type electron gun 30 having the above-mentioned structure, the diameter of the unit electron guns 30B, 30G and 30R must be made smaller, with the result that even a minute pre-deflection of the electron beam gives rise to a major aberration, thereby requiring a considerable distance L [mm].

By the very nature of the distance L [mm], it is generally discussed in terms of the ratio L/D which is the distance L divided by the inner diameter D [mm] in the rear end surface 51A of the core 51 (D is shown in FIG. 6). In actual practice, the value of L/D represented by this method is 0.9 normally, and 0.8 even if the value of L/D is extremely small. Further, the value of L/D is approximately 0.7 even in color CRT devices which are smaller (with a maximum deflection angle of 90° or thereabouts) and less expensive, in which not so much attention is paid to the picture quality.

To represent the permissible limits of L/D more concretely in a formal numerical expression, it is insufficient merely to make an objective evaluation of the degree of defocusing. Rather it is necessary to make a judgment based on the position of the product in the market. Since it is considered that, in the color CRT devices with a larger deflection angle, the amount of defocusing attributable to pre-deflection will obviously increase, and that the color CRT devices with a larger deflection angle are as a rule top-of-the-line products in which more emphasis is laid on the picture quality, L/D will be generally made larger. However, this opinion is very subjective indeed.

FIG. 7 is a diagram in which there is shown the relationship between the maximum deflection angle θ and L/D. In ordinary household color CRT devices having the phosphor layer 10 with a diagonal diameter of 45 [cm] or more (that is to say, a panel with a diagonal diameter of approximately 20 [inches] or more) and a deflection yoke of the saddle/toroidal type (S/T-type), years of experience and market comparisons between the products of various manufacturers have resulted in designs in which the value of L/D with respect to the maximum deflection angle θ satisfies or exceeds the value of the solid line that is represented by the following relational expression (1):

$$L/D=0.0075\theta-0.025 \quad (1)$$

That is to say, the color CRT device is designed so as to satisfy the following relational expression (2):

$$L/D\geqq 0.0075\theta-0.025 \quad (2)$$

The point which must be taken note of here is that the aforementioned standard (namely expression (1)) is the lower limit value for L/D when the aspect ratio K is 4/3, which has heretofore been the standard for the conventional cathode ray tubes.

Thus we may say that, since the value obtained from the expression (1) has come, by tacit consent, to be used as the lower limit value of the applicable range of L/D even in those color CRT devices having an aspect ratio K larger than 4/3, there has been no corroboration whatever as to whether, when the aspect ratio K is larger than 4/3, the value of L/D is actually applicable at values smaller than the lower limit value for L/D obtained by the expression (1).

When, on the other hand, the aspect ratio K is 4/3, the upper limit value for L/D may be regarded as 1.2, irrespective of the deflection angle. This is because an increase in L/D of this degree means that the influence of the leakage magnetic field from the rear end of the deflection yoke 50 on the electron beam spot diameter becomes negligible, while at the same time the influence of the image magnification factor on the electron beam spot diameter becomes larger as L/D increases, and the electron beam diameter increases.

This situation is depicted in FIG. 8, which is a diagram showing the relationship between the change in the electron beam spot diameter with respect to the value of L/D. In FIG. 8, the solid lines are graphs each showing the influence that the changes in image magnification factor due to L/D exert on the spot diameter and the influence that the deflection magnetic field due to the changes in L/D exerts on the spot diameter. In FIG. 8, the legend NTS signifies "not to scale." In FIG. 8, the broken line is a graph showing the changes in the spot diameter with respect to the changes in L/D.

The electron gun 30 is a device which focuses the image at the focal point of the electron beam in the vicinity of the cathode 32 on the phosphor layer 10 by means of the electron lens (which is not shown in the figures) formed in the gap 40. The change of the spot diameter due to changes of the value of L/D are dependent upon the influence of the leakage magnetic field and the influence of the image magnification factor. The image magnification factor is substantially identical to the distance from the phosphor layer 10 to the center point of the gap 40 divided by the distance from the cathode 32 to the center point of the gap 40.

It may be seen from FIG. 8 that when L/D is larger than 1.2, the influence of the image magnification factor becomes greater and the spot diameter increases, and, on the other hand, when L/D is smaller than approximately 1.0, the influence of the leakage magnetic field becomes greater and the spot diameter increases.

The conventional color CRT device has the above-mentioned structure. Recently, however, there has been an increase in the size of the color CRT devices, and progress in the display devices other than the color CRT devices has given rise to a more insistent need for a reduction in the depth (overall length) that has been the disadvantage of the color CRT devices.

Increasing maximum deflection angle θ is an effective means of reducing the overall length, but in this method of 114° deflection, in which the value of the deflection angle is made 114°, is the limit of the technology and no other effective means have been found to reduce the overall length.

Recently, technology has been disclosed as in, for example, U.S. patent Ser. Nos. 5,204,585 and 5,412,277, but the technology cited in both of these documents is characterized in that the overall length is reduced by providing an electric potential difference in the interval between electrodes corresponding to the aforementioned inner conductive film 6 and the high-voltage electrode 36, with the disadvantage that the structure becomes correspondingly more complex and the color CRT device more expensive.

The result has been that, while there is dissatisfaction with the color CRT devices used in ordinary household television sets and the like, designs have provided virtually no improvement in terms of overall length.

Even when the aspect ratio K is greater than 4/3, the lower limit value for L/D used was that of the expression (1), that is to say, the lower limit value for L/D when the aspect ratio K is 4/3. This is because notice had not been taken of the relationship between the lower limit value for L/D and the aspect ratio K when the aspect ratio K was greater than 4/3. That is to say, the idea of designing the lower limit value for L/D on the basis of the relationship between L/D and the aspect ratio K had not been conceived in the prior art.

SUMMARY OF THE INVENTION

It is an object of the present invention to provide a color CRT device satisfying such a condition which makes the electron beam spot diameter enough small and makes the overall length of the device less than that according to the prior art, even when the aspect ratio is greater than 4/3.

According to the present invention, a color CRT device has a cathode ray tube and a deflection coil. The cathode ray tube includes a panel provided with a phosphor surface which is approximately rectangular, has a diagonal diameter of 45 [cm] or more, and has an aspect ratio greater than 4/3; a funnel connected to the panel; a neck connected to the funnel; a stem connected to the neck; and an electron gun, which is positioned inside the neck, including a high-voltage electrode, and a focusing electrode mounted between the high-voltage electrode and the stem and disposed in proximity to the high-voltage electrode across a gap. The deflection yoke includes a core which cross-section perpendicular to a tube axis of the cathode ray tube is approximately annular; a first deflection coil for deflecting in a horizontal direction an electron beam emitted by the electron gun, a winding type of the first deflection coil being a saddle type; and a second deflection coil for deflecting in a vertical direction the electron beam emitted by the electron gun, a winding type of the second deflection coil being a toroidal type. Herein the color CRT device satisfies a following relational expression:

$$\frac{\sqrt{\frac{1}{1+K^2}}}{\frac{0.113\theta+0.563}{0.0075\theta-0.025}-2.5\sqrt{\frac{1}{1+K^2}}} \leqq \frac{L}{D} \leqq \frac{\sqrt{\frac{1}{1+K^2}}}{2.0-2.5\sqrt{\frac{1}{1+K^2}}}$$

where

L [mm] denotes a distance between a central position of the gap and an end surface of the core on a side of the stem, D [mm] denotes an inner diameter of the core on the side of the stem, θ denotes a maximum deflection angle of the cathode ray tube, and K denotes the aspect ratio.

When the design is such that the value of L/D lies in the above-mentioned range, it is possible to reduce the overall length of the color CRT device without adversely affecting the practicability of its focusing characteristics.

Further, when the aspect ratio K is 16/9, it is desirable that a following relational expression is satisfied:

$$0.003\theta+0.14 \leqq L/D \leqq 0.63$$

When the design is such that the value of L/D lies in the above-mentioned range, it is possible to reduce the overall length of the color CRT device without adversely affecting the practicability of its focusing characteristics.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the present invention will be described with reference to the accompanying drawings.

First Embodiment

Figure 1:
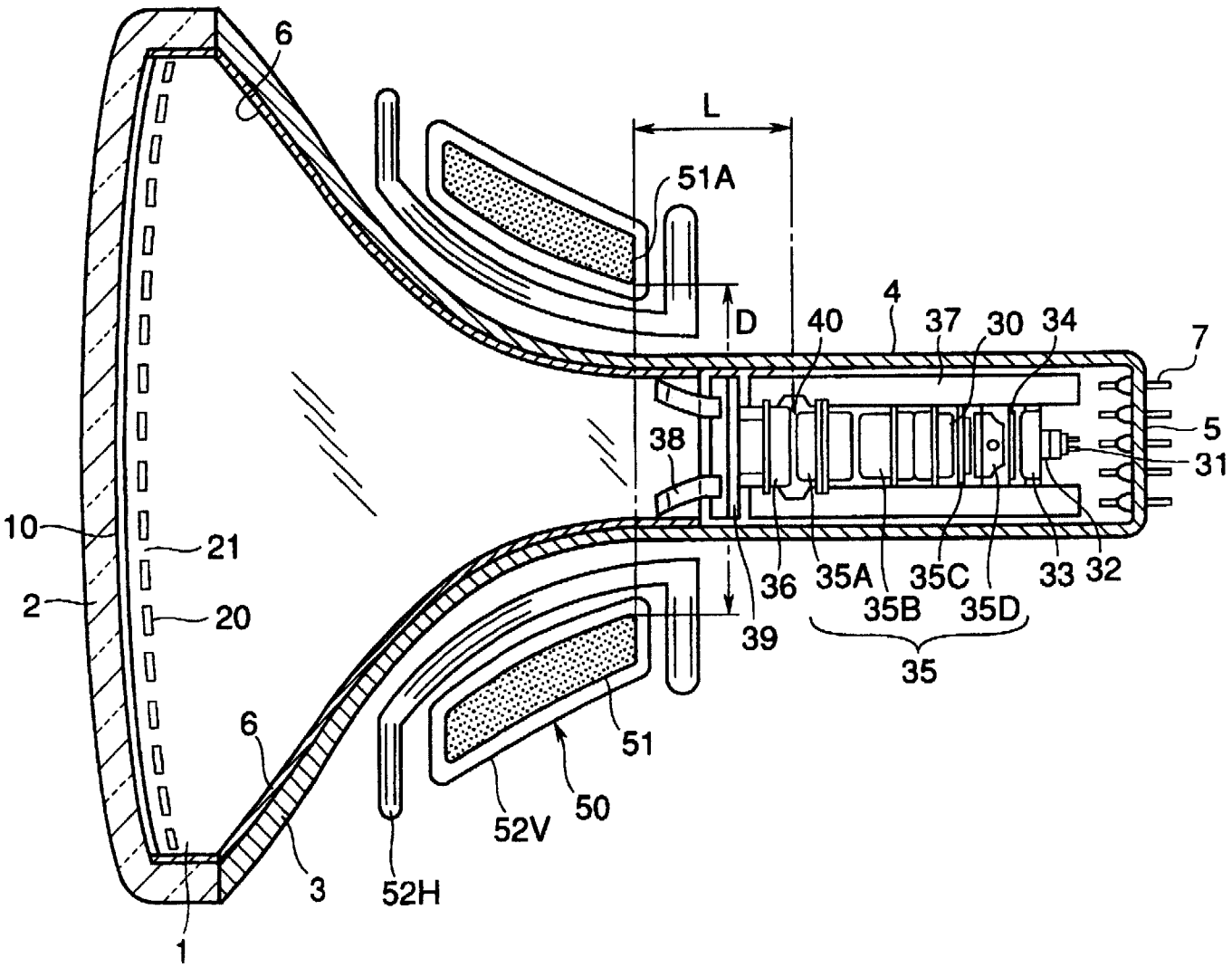
FIG. 1 is a partial horizontal cross-section showing a color CRT device according to a first embodiment of the present invention.
Figure 5A:
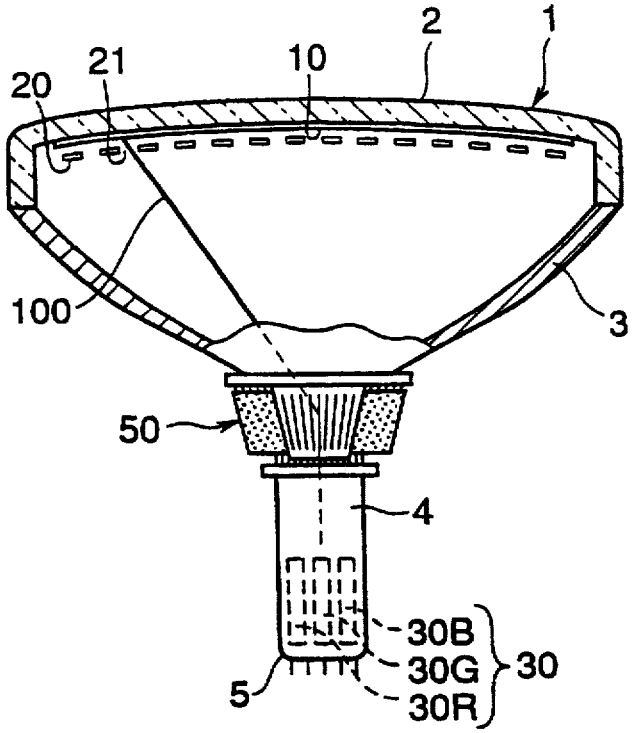
FIG.5A CONVENTIONAL ART
FIGS. 5A and 5B are a plan view partially cut away and a front view of a conventional color CRT device.
Figure 5B:
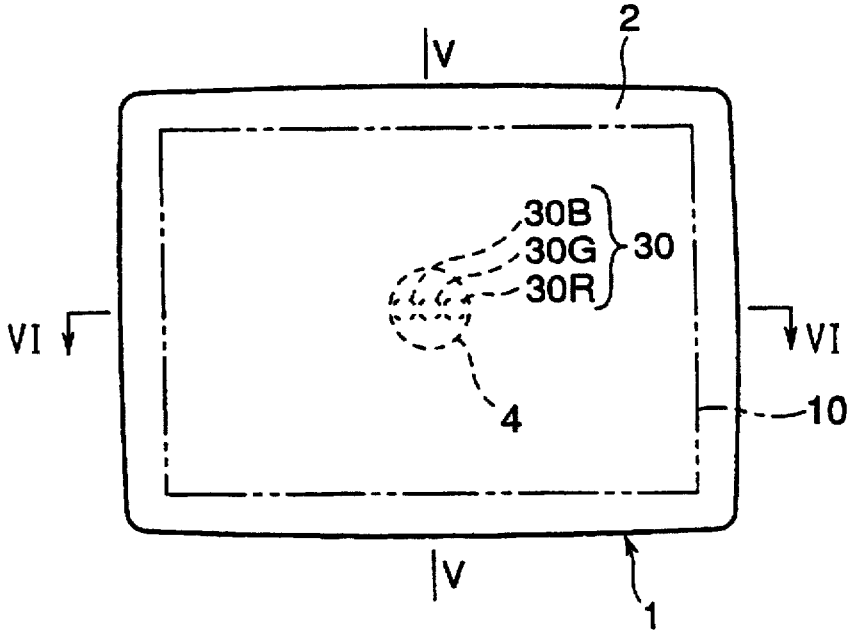
FIG.5B CONVENTIONAL ART
Figure 6:
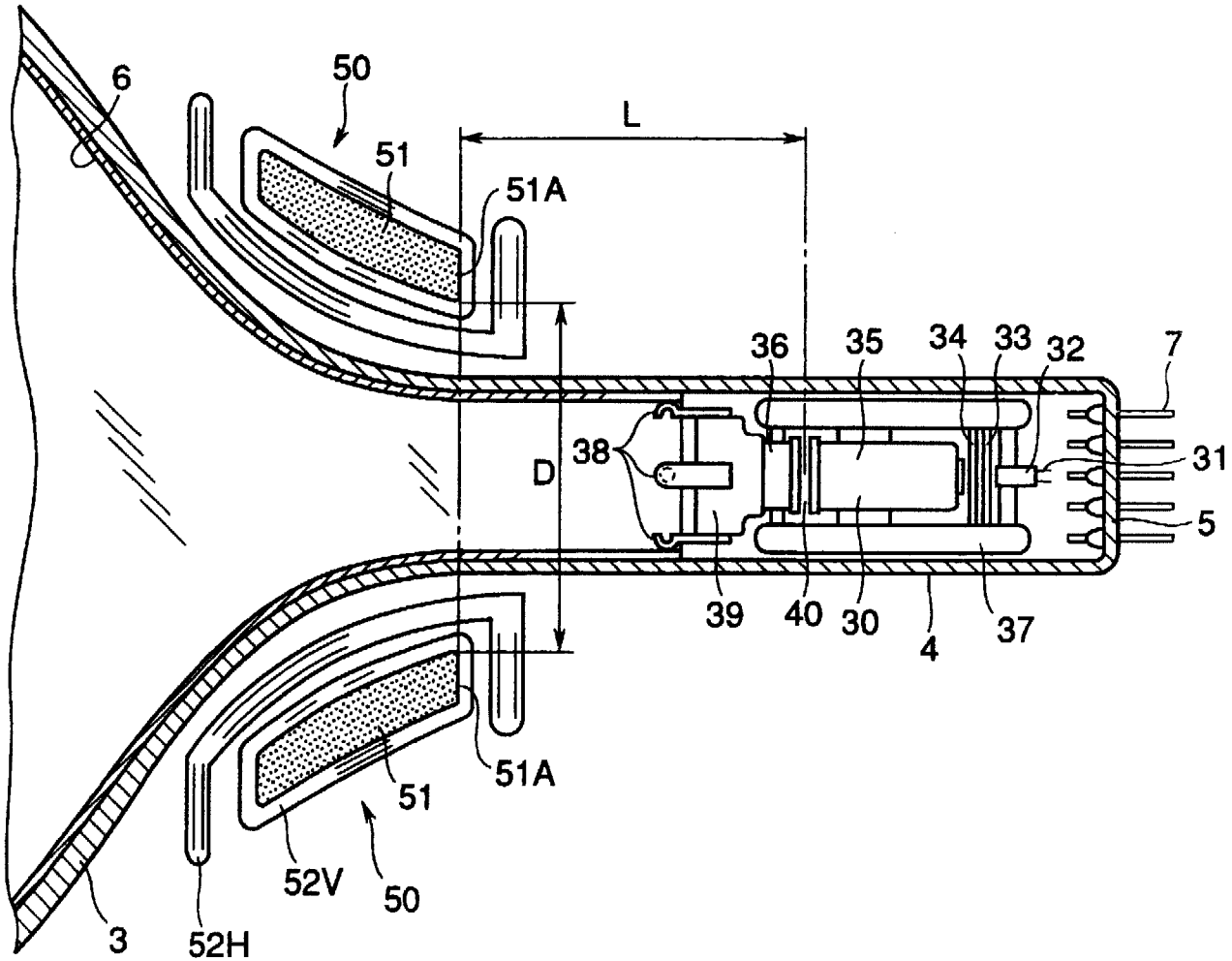
FIG.6 CONVENTIONAL ART
FIG. 6 is a partial horizontal cross-section of the color CRT device of FIGS. 5A and 5B.
Figure 7:
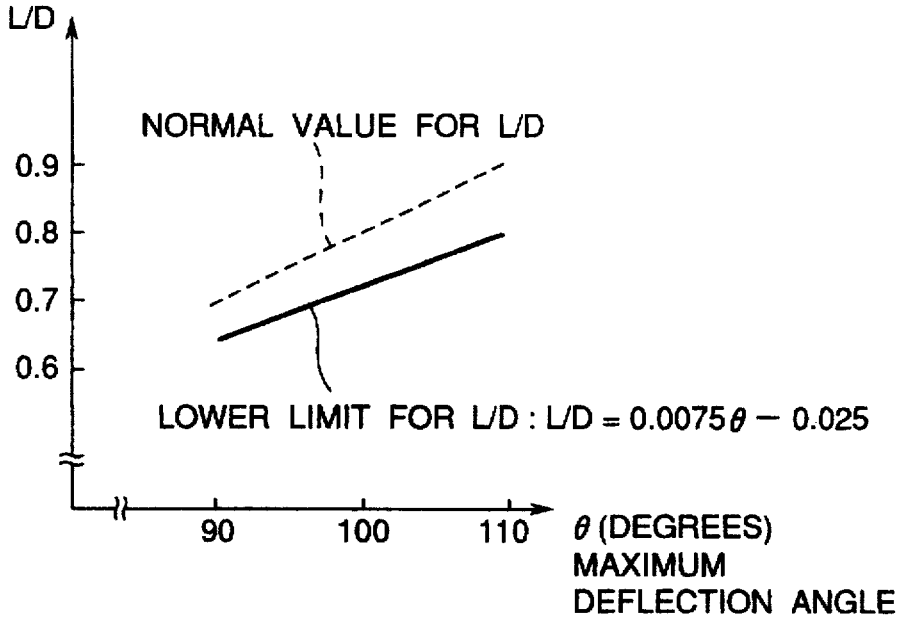
FIG.7 CONVENTIONAL ART
FIG. 7 is a graph showing a relationship between the maximum deflection angle θ and the lower limit value for L/D, when the aspect ratio K is 16/9.

FIG. 1 is a partial horizontal cross-section showing a color CRT device according to a first embodiment of the present invention. Those elements in FIG. 1 which are identified by the same symbols as in the conventional device (FIGS. 5A and 5*b* and FIG. 6) are identical or correspond to those of the conventional device.

In FIG. 1, a reference numeral 35 designates a focusing electrode, 35A designates a main electrode of the focusing electrode 35, and 35B, 35C and 35D designate auxiliary electrodes of the focusing electrode 35. The main electrode 35A and the auxiliary electrodes 35B, 35C and 35D constitute a single focusing electrode 35. A reference numeral 36 designates a high-voltage electrode, a rear end of which faces a front end of the focusing electrode 35.

A reference numeral 40 designates a gap formed between a rear end of the high-voltage electrode 36 and a front end of the focusing electrode 35 (i.e., a front surface of the main electrode 35A).

Figure 2:
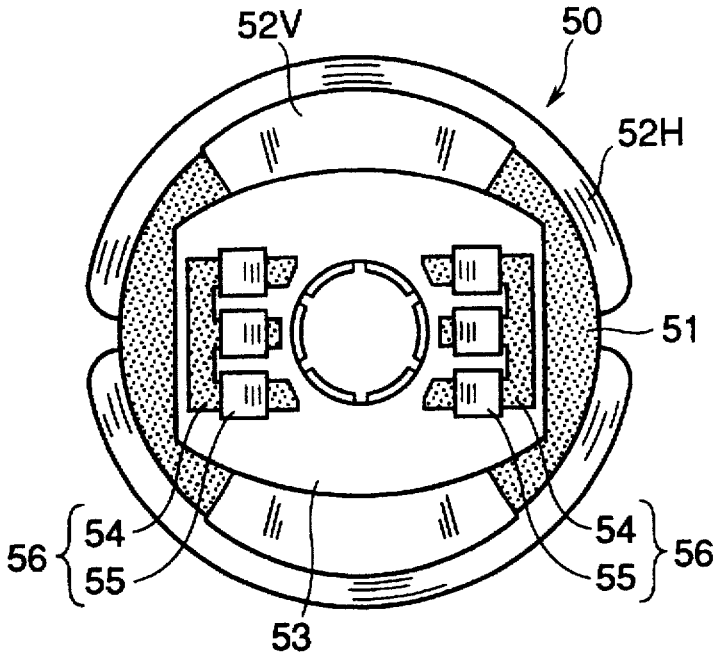
FIG. 2 is a diagram showing a deflection yoke of the color CRT device according to the first embodiment when viewed from a stem side.

FIG. 2 is a diagram showing a deflection yoke 50 of the color CRT device of FIG. 1 when viewed from a side of the stem 5. Those elements in FIG. 2 which are identified by the same symbols as in the conventional device (FIGS. 5A and 5*b* and FIG. 6) are identical or correspond to those of the conventional device.

In FIG. 2, a reference numeral 53 designates the rear end surface of the deflection yoke 50. A reference numeral 54 designates a pair of E-shaped cores, and 55 designates coils wound onto the E-shaped cores 54.

A reference numeral 56 designates an auxiliary magnetic field generating device which is provided in order to optimize the magnetic field of the deflection yoke 50 (namely, in order to obtain the self-convergence function). The auxiliary magnetic field generating device 56 includes a pair of E-shaped cores 54 and coils 55 wound onto the E-shaped cores 54. The current flowing in the coils 55 is synchronized with the vertical deflection current flowing in the vertical deflection coil 52V.

A color CRT device according to the first embodiment is characterized in that, taking the distance between a center position of the gap 40 and the rear end surface 51A of the core 51 (that is to say, the end surface of the core 51 on the side of the stem 5) as L, an inner diameter of the rear end surface 51A of the core 51 (that is to say, the end of the core 51 on the side of the stem 5) as D, and an aspect ratio as K, when the overall length is less than that in accordance with the conventional deivice and the spot diameter of the electron beam is of approximately the same size as that in accordance with the conventional device, the value of L/D has been found to be lower than the value that has been considered in the conventional art to be the lower limit value for L/D which has been indicated in the expression (1).

Following is an explanation of the grounds for the lower limit value for L/D thus newly found.

As is well known, the color CRT device has been substantially perfected as a display device with a picture quality which is substantially satisfactory. Its main disadvantage is its physical size, and specifically the length of the depth dimension.

To overcome this disadvantage, the inventors have subjected representative color CRT devices having a saddle/toroidal-type (S/T-type) deflection yoke 50 to a variety of experiments, as a result of which a new knowledge, hereinafter described, has been obtained with regard to the position of the electron gun 30 within the neck 4, which is one of the factors that determine the overall length of the color CRT device.

Firstly, the fact that defocusing (or an increase in the electron beam spot diameter) is produced when the value of L/D is reduced is primarily due to the influence of the vertical deflection magnetic field. That is to say, the most important cause of this defocusing is that the electron beam is subjected, prior to its reaching the gap 40, to a pre-deflection due to the vertical deflection leakage magnetic field, caused by the vertical deflection coil 52V of the deflection yoke 50 which has a winding of the toroidal type, with the result that those electrons, which are on the outside of the electron beam flux at the position of the gap 40 (namely, the position of the focusing lens formed in the vicinity of the gap 40) and which are pre-deflected and excited further to the outside, exhibit symptoms of over-focusing on the phosphor layer.

Further, the influence of the horizontal deflection magnetic field is extremely small, despite the fact that the deflection angle in the horizontal direction is generally larger than that in the vertical direction. This is due not only to the fact that the horizontal deflection coil 52H has a saddle type winding, but also to the fact that, since the sawtooth current flowing in the horizontal deflection coil 52H to produce the horizontal deflection is of a high frequency, an eddy current is produced within the electrode of the electron gun, and the magnetic field produced by this eddy current has a major influence in canceling out the pre-deflection magnetic field. Be that as it may, when the deflection yoke 50 is of the S/T-type, the increase in the spot diameter due to the pre-deflection of the beam by the horizontal deflection magnetic field may, for practical purposes, be ignored.

Further, the electron beam spot diameter in the vertical direction presents a problem at the upper and lower ends, where the vertical deflection angle on the phosphor layer is large, and particularly at the corners. The electron beam spot diameter $d_v$ in the vertical direction for an ordinary S/T-type deflection yoke 50 may, provided the diagonal diameter of the image surface of the cathode ray tube 1 (that is to say, the phosphor layer 10) remains constant, be substantially represented by the following approximation expression (3):

$$d_V = F(I)\left(1.0 + \frac{0.4}{\left(\frac{L}{D}\right)}\right)\tan\left(\frac{\theta_V}{2}\right) \tag{3}$$

where F(I) is a function of current I due to the electron beam, which is determined by the type of the electron gun 30 and the detailed structure of the deflection yoke 50, and $\theta_v$ is the vertical deflection angle.

This approximation expression (3) can, however, be applied to the color CRT devices with a phosphor layer having a diagonal diameter of 45 [cm] or more. Further, for the color CRT devices with an aspect ratio K of 4/3, the range, to which the L/D applicable to the expression (3) can be applied, may be regarded as not less than 0.3 nor more than 1.2.

That is to say, given an aspect ratio K of 4/3, when L/D exceeds 1.0, the vertical electron beam spot diameter $d_v$ obtained from the expression (3) exhibits a tendency to decrease somewhat, whereas actual vertical electron beam spot diameter is substantially constant when L/D exceeds 1.0 and tends to increase when L/D exceeds 1.2. Accordingly, when L/D exceeds 1.2, a discrepancy appears between the vertical electron beam spot diameter $d_v$ of the expression (3) and actual vertical electron beam spot diameter.

When the aspect ratio K becomes greater than 4/3, however, the upper limit value for L/D (i.e., the upper limit value for the range within which L/D is applicable) becomes less than 1.2. The detailed explanation will appear later.

Here, a change in L/D is equivalent, electro-optically speaking, to a change in the image magnification factor of the electron lens (which is not shown in the figures) which is formed primarily between the focusing electrode 35 and the high-voltage electrode 36 in order to form, on the phosphor layer 10, an image of the concentrated point of the electron beam formed in the vicinity of the cathode 32. The expression (3) takes into account for the influence of the change in L/D.

That is to say, the applicable range of L/D is set so that the aforementioned influence of the change in L/D is taken into account and the value of the electron beam spot diameter can be approximately obtained by means of $d_v$ of the expression (3).

The expression (3) is an empirical equation relating to the electron beam spot diameter $d_v$, taking into account L/D, to which attention has not generally been paid in the past.

Further, since the influence of L/D decreases in those areas of the phosphor layer 10 other than the upper and lower edges, it is only necessary to consider the corner portions, which are subjected to the influence of the horizontal deflection. This is because the vertical electron beam spot diameter $d_v$ increases due to the main deflection magnetic field of the horizontal deflection yoke 52H within the deflection yoke 50, even if the influence of pre-deflection due to leakage magnetic flux of the horizontal deflection yoke 52H is slight.

Note also that if L becomes smaller, the electron beam spot diameter when not deflected, i.e., when the horizontal deflection and the vertical deflection are not carried out, becomes smaller due to changes in the image magnification factor. Accordingly, when dealing with the central portion of the phosphor layer, the electron beam spot diameter becomes smaller as L/D becomes smaller, and a smaller L/D is desirable.

The important conclusion which may be drawn from the above discussion is that, for the color CRT devices using a deflection yoke 50 of the S/T-type, if the aspect ration K is made greater, there is room to decrease L/D below the lower limit value considered in the conventional art, even when the diagonal diameter and the maximum deflection angle θ of the phosphor layer 10 are constant.

That is to say, it was found that, if the aspect ratio K is made greater than 4/3, it is possible to reduce the overall length (i.e., depth) of the color CRT device even when L/D is lower than the value heretofore considered the lower limit value, and, moreover, to obtain the color CRT device with substantially the same electron beam spot diameter in the vertical direction as that of the conventional color CRT device. A detailed explanation follows.

First, let us obtain an expression which indicates the lower limit value for L/D and is applicable even when the aspect ration K is greater than 4/3. Herein, the lower limit value for L/D is a value when the deflection angel is the maximum deflection angle θ which has heretofore been used as a rule of thumb when the aspect ration K is 4/3.

Generally speaking, the relationship among the aspect ratio K, the maximum deflection angle θ and the vertical deflection angle $\theta_v$ may be expressed as the following expression (4):

$$\tan\left(\frac{\theta_V}{2}\right)=\tan\left(\frac{\theta}{2}\right)\times\sqrt{\frac{1}{1+K^2}} \tag{4}$$

In fact, the phosphor layer 10 is a curved surface, but in this embodiment we assume it to be a simple flat plane.

Next, we assume the deflection yoke is the S/T-type and the diagonal diameter of the phosphor surface is greater than 45 [cm], and we take the electron beam spot diameter in the expression (3) as $d_{v1}$, with the result that the following expression (5) is obtained:

$$d_{V1}=\left(1.0+\frac{0.4}{\frac{L}{D}}\right)\times\tan\left(\frac{\theta_V}{2}\right)=\left(1.0+\frac{0.4}{\frac{L}{D}}\right)\times\tan\left(\frac{\theta}{2}\right)\times\sqrt{\frac{1}{1+K^2}} \tag{5}$$

Thus, using the above-mentioned expression (1) in which K=4/3, the permissible limit value of $d_{v1}$ may be represented as a function of the maximum deflection angle θ.

Thus, we again show the expression (1):

$$L/D=0.0075\theta-0.025 \tag{1}$$

If, on the other hand, holding the inch size and maximum deflection angle θ of the color CRT device constant, we apply the expression (4) to the case in which the aspect ratio K is 4/3, we obtain the following expression (6):

$$\tan\left(\frac{\theta_V}{2}\right)=\tan\left(\frac{\theta}{2}\right)\times\sqrt{\frac{1}{1+\left(\frac{4}{3}\right)^2}}=0.6\times\tan\left(\frac{\theta}{2}\right) \tag{6}$$

Thus, if we express the upper limit value of $d_{v1}$ as SUP ($d_{v1}$), we obtain the following expression (7):

$$\begin{aligned}SUP(d_{V1}) &= \left(1.0+\frac{0.4}{0.0075\theta-0.025}\right)\times\tan\left(\frac{\theta}{2}\right)\times\sqrt{\frac{1}{1+\left(\frac{4}{3}\right)^2}}\\ &= \frac{0.0075\theta+0.375}{0.0075\theta-0.025}\times0.6\times\tan\left(\frac{\theta}{2}\right)\end{aligned} \tag{7}$$

From the expressions (5) and (7), the general expression (8) for the values of L/D which are permissible as the relationship between the aspect ratio K and the maximum deflection angle θ is as follows:

$$\left(1.0+\frac{0.4}{\frac{L}{D}}\right)\times\tan\left(\frac{\theta}{2}\right)\times\sqrt{\frac{1}{1+K^2}}\leq\frac{0.0075\theta+0.375}{0.0075\theta-0.025}\times0.6\times\tan\left(\frac{\theta}{2}\right) \tag{8}$$

If we then cancel out tan (θ/2) in both of the terms, we obtain the following expression (9):

$$\frac{L}{D} \geqq \frac{\sqrt{\frac{1}{1+K^2}}}{\frac{0.113\theta+0.563}{0.0075\theta-0.025} - 2.5\sqrt{\frac{1}{1+K^2}}} \quad (9)$$

This expression (4) indicates the lower limit value for L/D as calculated from the relationship between the aspect ratio K and L/D for cases in which the aspect ratio K exceeds 4/3.

Next let us consider the upper limit value for L/D.

As has been stated above, the actual upper limit value for L/D when the aspect ratio K is 4/3 is 1.2. It is of no practical significance even if L/D is made even larger. Solving the expression (5) using a value of 4/3 for K and 1.2 for L/D, we find the following expression (10):

$$d_V = \left(1.0 + \frac{0.4}{1.2}\right) \times 0.6 \tan\left(\frac{\theta}{2}\right) = 0.8 \tan\left(\frac{\theta}{2}\right) \quad (10)$$

When the aspect ratio K is greater than 4/3, the vertical electron beam spot diameter is considered satisfactory even if L/D is increased, provided it does not exceed the value $d_v$ of the expression (10).

Thus if, as a matter of policy, the upper limit value for L/D for the general case in which the aspect ratio K is greater than 4/3 is set at a value which does not exceed the $d_v$ of the expression (10), we obtain the following expression (11):

$$\left(1.0 + \frac{0.4}{\frac{L}{D}}\right) \tan\left(\frac{\theta}{2}\right) \times \sqrt{\frac{1}{1+K^2}} \geqq 0.8 \tan\left(\frac{\theta}{2}\right) \quad (11)$$

If we then cancel out tan (θ/2) in both terms of the expression (11), we obtain the following expression (12):

$$\frac{L}{D} \leqq \frac{\sqrt{\frac{1}{1+K^2}}}{2.0 - 2.5\sqrt{\frac{1}{1+K^2}}} \quad (12)$$

Figure 3:
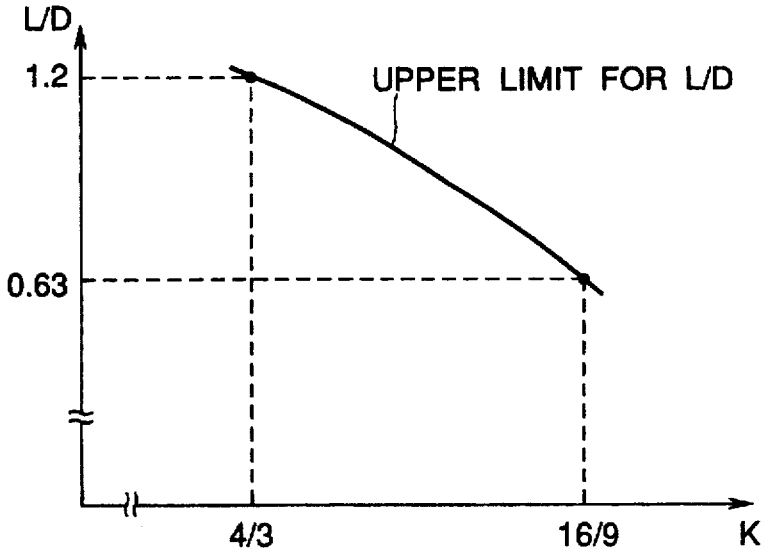
FIG. 3 is a graph showing a relationship between the aspect ratio K and the upper limit value for L/D.

If we then calculate L/D in the expression (12) using various values of K, we obtain the graph shown in FIG. 3. This may be called the upper limit value for L/D as formally calculated on the basis of the policy described above.

It has been realized, however, that the electron beam spot diameter $d_v$ at the upper limit value for L/D as thus formally calculated agree with the actual upper limit value when the aspect ratio K is 4/3, as well as it is also the actual upper limit value for the respective values of K (such that even if L/D is increased, the value of $d_v$ cannot be reduced).

For example, the formal upper limit value for L/D found using the expression (12) for the case in which the aspect ration K is 16/9 will be 0.63.

In this region, whereas the electron beam spot diameter $d_v$ according to the expression (5) decreases gradually with an increase of L/D, the actual spot diameter ceases to exhibit change in this area and as L/D further increases, clearly begins to increase. This demonstrates that the applicable upper limit value for L/D in the expression (5) decreases with the aspect ratio K, and that FIG. 3 shows the actual upper limit.

Figure 8:
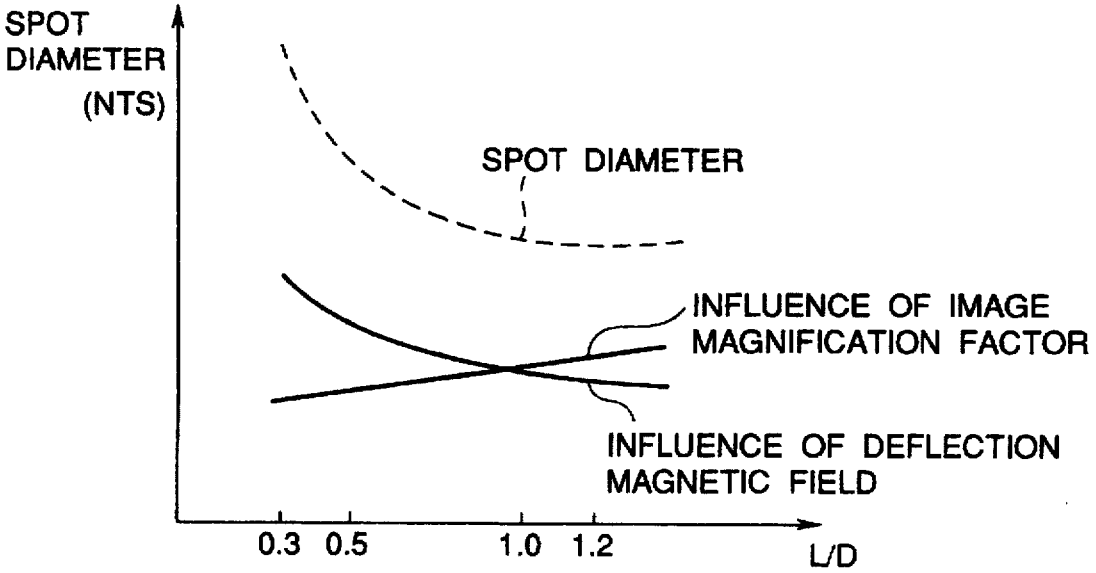
FIG.8 CONVENTIONAL ART
FIG. 8 is a graph showing the relationship between L/D and an electron beam spot diameter for the conventional color CRT device.

This phenomenon may be explained by the same principle as that illustrated by FIG. 8.

In the expression (12), the upper limit value for L/D may also be considered as related to the maximum deflection angle θ of the color CRT device. In the color CRT device with a large maximum deflection angle θ, for example, the vertical deflection angle is large even when the aspect ratio K remains constant, with the result that the upper limit value for L/D may be large.

In comparing the color CRT devices each having the phosphor layer 10 of the same size, the distance between the phosphor layer 10 and the gap 40 is smaller in the color CRT device with a larger maximum deflection angle θ than it is in one with a smaller maximum deflection angle θ, with the result that the change in the magnification factor relative to the change in L/D is also smaller.

Thus it has been thought that, due to the canceling out of these two effects, the upper limit value for L/D is not dependent upon the maximum deflection angle θ.

The present invention has the effect of reducing the overall length of the color CRT device to less than that of the conventional color CRT devices, even when using the value of L/D less that heretofore considered to be the lower limit value for L/D. That is to say, it is possible to reduce the overall length of the color CRT devices by making the value of L/D to be satisfied with the expressions (1) and (9).

Specifically, if we design L/D in a range in which the expressions (9) and (12) are satisfied at the same time, it is possible to reduce the overall length of the color CRT device to less than that of the conventional color CRT devicest.

In accordance with the present invention, the effect of decreasing the overall length will be greater the closer L/D is to the value in the right-hand side of the expression (9), and in particular, the effect of reducing the overall length will be even greater when the maximum deflection angle is 90° or more, or, what is even more desirable, 100° or more, and the value chosen for L/D is in the vicinity of the lower limit value as calculated in the expression (9).

Let us take, as an example of the phosphor layer 10 having an aspect ratio K greater than 4/3, one that is currently in increasingly frequent use, in which the aspect ratio K is 16/9.

If we calculate the lower limit values for L/D using the expression (9), we arrive at the following values:

TABLE 1

| Maximum deflection angle θ (degrees) | 90 | 100 | 110 |
|---|---|---|---|
| Lower limit value for L/D | 0.41 | 0.44 | 0.47 |

Figure 4:
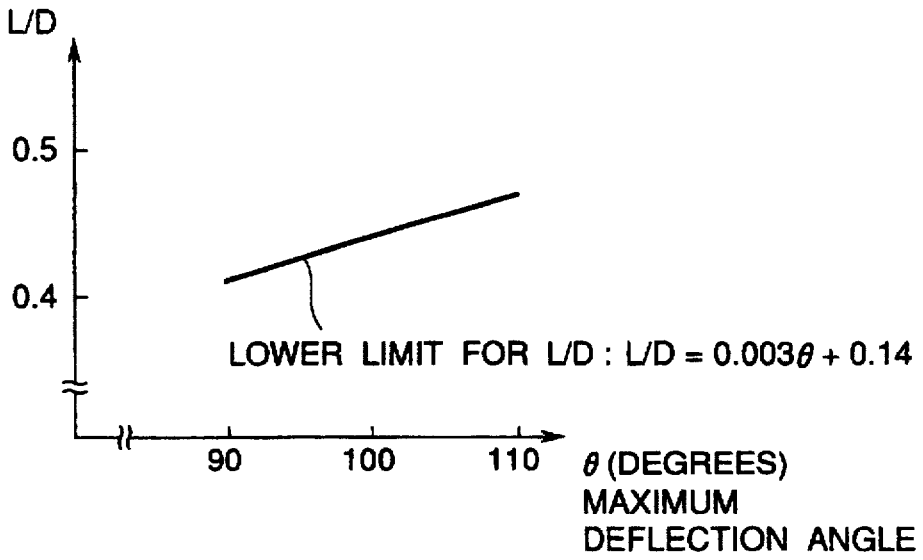
FIG. 4 is a graph showing a relationship between the maximum deflection angle θ and the lower limit value for L/D, when the aspect ratio K is 16/9.

FIG. 4 shows an approximation of this table 1 by means of a first-order function. In FIG. 4, the relationship between the maximum deflection angle θ and the lower limit value for L/D when the aspect ratio K is 16/9 is as follows:

$$L/D = 0.003\theta + 0.14 \quad (13)$$

Accordingly the lower limit value for L/D should be chosen such that the following expression (14) is satisfied:

$$L/D \geqq 0.003\theta + 0.14 \quad (14)$$

Note that when the aspect ratio K is 16/9, the upper limit value for L/D obtained from the expression (12) and FIG. 3 is 0.63.

Thus the range of L/D relative to the maximum deflection angle θ when the aspect ratio K is 16/9 may be expressed as $$0.003\theta + 0.14 \leqq L/D \leqq 0.63 \quad (15)$$

When we compare the conventional art lower limit value with 0.63, we obtain, from the expression (1)

$$0.63 < 0.0075\theta - 0.025 \quad (16)$$

where $\theta \geqq 90°$, so that, when $\theta$ is 90° or more, it is possible to decrease the overall length of the color CRT device while maintaining a vertical electron beam spot diameter $d_v$ of the same order as that of the conventional device within a range of lower limit values for L/D which is lower (the expression (15)) than the lower limit values in the expression (1), and that was not considered applicable in conventional art.

Any decrease in L/D will obviously involve a certain amount of degradation in terms of the vertical electron beam spot diameter $d_v$, even if only to the degree found in conventional art. Thus the present invention should be practiced only in those types of tubes in which shortening of the overall length is needed. From this point of view, the present invention will be most advantageously applied to those types of tube having a deflection angle greater than a certain amount. That is to say, among standard products, particularly in those tubes in which the maximum deflection angle $\theta$ is less than 100°, in which the funnel 3 is comparatively long and the electron gun accounts for a smaller proportion of the overall length, there still is room to increase the deflection angle without sacrificing economy. Accordingly the present invention particularly recommends itself for practice in products having a maximum deflection angle $\theta$ of 100° or more.

In this respect, a comparison of the expression (9) with expression (2) points clearly to the fact that the margin for decreasing the L/D produced when the aspect ratio K increases is greater in those tubes having a greater maximum deflection angle $\theta$.

If these facts are taken into account, it becomes possible further to reduce the overall length of the color CRT device when the value of D is constant by making the maximum deflection angle $\theta$ no less than 100° and making the value of L/D within the range that satisfies the expression (15).

Further, the amount of the length reduction will increase to the extent that the value L/D is approached the value obtained from the right-hand side of the expression (9).

Second Embodiment

To confirm the suitability of the expressions set forth above, measurements of the electron beam spot diameter were carried out for the color CRT device having the structure shown in FIG. 1.

Measurements involved the horizontal spot diameter $d_H$ and the vertical spot diameter $d_v$ with the following parameters set:

TABLE 2

| | |
|---|---|
| Dimensions of tube 1 | 28-inch |
| Maximum deflection angle | 106° |
| Horizontal deflection angle | 96° |
| Vertical deflection angle | 62° |
| Diameter of phosphor layer on horizontal axis | 575.2 [mm] |
| Diameter of phosphor layer on vertical axis | 323.6 [mm] |
| Aspect ratio | 16/9 |
| Outer diameter of neck 4 | 29.1 [mm] |
| Overall length | 425 [mm] |
| Type of winding of vertical deflection coil 52V | Toroidal |
| Inner diameter of rear end surface 51A (D in FIG. 1) | 50 [mm] |

TABLE 2-continued

| | |
|---|---|
| Gap 40 between rear end surface 51A and electron gun 35 | 24.1 [mm] |
| L/D | 0.482 |
| Type of electron gun | WTDS Type W66LFU61X registered with Japanese Organization named "Electronic Industries Association of Japan (EIAJ)" |

Note, however, that the deflection yoke used for the deflection yoke 50 was the ordinary S/T-type, on which the auxiliary magnetic field generating device 56 with the coil 55 wound onto the E-shaped cores 54, which is shown in FIG. 2, is not mounted.

During the experiments to measure the spot diameter $d_v$, when the color CRT device was operated at an anodic voltage (voltage applied between the inner conductive film 6 and the high-voltage electrode 36) of 30 [kV], with a voltage of approximately 28% of anodic voltage applied to the focusing electrode 35 under optimum fine-tuning conditions with reference to the center of the image, the vertical spot diameter and the horizontal spot diameter at the corners of the phosphor layer 10 were as follows:

TABLE 3

| | |
|---|---|
| Horizontal spot diameter $d_H$ | 8.3 [mm] |
| Vertical spot diameter $d_V$ | 4.0 [mm] |

Next, when measurements of the spot diameter were carried out with the distance from the rear end surface 51A of the core 51 to the center of the gap 40 of the electron gun 30 (L in FIG. 1) set to 31.0 [mm] and the other conditions as set forth above, the following results were obtained, when L/D was 0.62.

TABLE 4

| | |
|---|---|
| Horizontal spot diameter $d_H$ | 8.4 [mm] |
| Vertical spot diameter $d_V$ | 3.1 [mm] |

Note that the data reported above are the values for the central one of three in-line unit electron guns 30R, 30G and 30B, and beam current I was 4.0 [mA]. The reason for directing our attention here to the central unit electron gun 30G is that this electron beam (the center beam) is the one that causes emission by the green phosphor layer, being highly sensitive in visual terms and actually controlling resolution.

In this embodiment, the $d_v$ of the side beams was actually influenced less by the reduction in L than was that of the center beam.

Further, at a beam current I of 4.0 [mA] which is considered to be virtually the maximum that is practicable for this type of electron gun, the influence of the reduction of L was less than at this peak current.

When, in order to examine the fit with the expression (3), we adopted the same structure with only the position of the electron gun changed so that L=44.1 [mm] (L/D=0.882), the values obtained for horizontal and vertical spot diameter were as follows:

TABLE 5

| | |
|---|---|
| Horizontal spot diameter $d_H$ | 8.6 [mm] |
| Vertical spot diameter $d_V$ | 3.2 [mm] |

From this it can be seen that the values obtained for the vertical spot diameter $d_v$ were approximately the same as those of conventional art. It was further found that the horizontal spot diameter was better than the conventional art value.

From these results it can be seen that, in a color CRT devices according to the second embodiment when at L/D was 0.882 and 0.62, the horizontal spot diameter $d_H$ was clearly improved.

When, furthermore, this electron gun was used in a cathode ray tube having the same deflection angle and an aspect ratio of 4/3 when the distance L was 44.1 [mm], $d_v$ at the corners was 3.9 [mm]. Because it was impossible to procure a bulb having an aspect ratio of 4/3 and the same deflection angle and size, this is an interpolation from an experimental cathode ray tube of specifications that are similar to these.

The major point of difference between the color CRT device of the second embodiment and one according to conventional art is in the use of a value for L/D that is smaller than the value previously considered to be the lower limit. Previously, an L/D of 0.882 was a sort of standard for this deflection angle.

In the second embodiment, the explanation was in terms of examples with L/D values of 0.882 and 0.62. Under the conditions described above, the color CRT devices according to the conventional art were designed using a lower limit of $$L/D \geq 0.77 \quad (17)$$

obtained by substituting θ=106° into the expression (2), whereas, in the color CRT device according to the first embodiment, when the value adopted for L/D was in a range that was inconceivable in the conventional art, namely $$0.46 \leq L/D \leq 0.63 \quad (18)$$

obtained by substituting θ=106° into the expression (15), the effect was obtained that the vertical spot diameter was approximately the same as in the conventional art while the horizontal spot diameter was better than in the conventional art.

In contrast to the conventional art lower limit value for L/D, taken from the expression (17), which was 0.77, the adoption of the value of 0.63 in the color CRT device according to the second embodiment makes possible a reduction in length of at least $$50 \times (0.77 - 0.63) = 7.0 \text{ [mm]}$$

In the second embodiment, the explanation was in terms of empirical results for a specific value for the conventional art L/D of 0.882.

The overall length reduction effect of this adopted value may thus be represented for an L/D of 0.482 as $$50 \times (0.882 - 0.482) = 20.0 \text{ [mm]}$$

and for an L/D of 0.62 as $$50 \times (0.882 - 0.62) = 13.1 \text{ [mm]}$$

making possible, when D is constant, a reduction in length of 20 [mm] when L/D is 0.482, and of 13.1 [mm] when L/D is 0.62. It is also possible to achieve a spot diameter that is substantially the same as that of the conventional art in the vertical direction, and even smaller than that of the conventional art in the horizontal direction.

Third Embodiment

To confirm the suitability of the expressions set forth above, measurements of the spot diameter were carried out for a color CRT device having the structure shown in FIG. 1.

Measurements involved the horizontal spot diameter $d_H$ and the vertical spot diameter $d_v$ with the following parameters set:

TABLE 6

| | |
|---|---|
| Dimensions of tube 1 | 32-inch |
| Maximum deflection angle | 106° |
| Horizontal deflection angle | 96° |
| Vertical deflection angle | 62° |
| Diameter of phosphor layer on horizontal axis | 661.0 [mm] |
| Diameter of phosphor layer on vertical axis | 371.5 [mm] |
| Aspect ratio | 16/9 |
| Outer diameter of neck 4 | 29.1 [mm] |
| Overall length | 479.5 [mm] |
| Type of winding of vertical deflection coil 52V | Toroidal |
| Inner diameter of rear end surface 51A (D in FIG. 1) | 50 [mm] |
| Gap 40 between rear end surface 51A and electron gun 30 | 30 [mm] |
| L/D | 0.60 |
| Type of electron gun | WTDS Type W76LHJ061X registered with Japanese Organization named "Electronic Industries Association of Japan (EIAJ)" |

During the experiments to measure the spot diameter, when the color CRT device was operated at an anodic voltage of 32 [kV] with a voltage of approximately 29% of anodic voltage applied to the focusing electrode 35 under optimum fine-tuning conditions with reference to the center of the image, the vertical spot diameter and horizontal spot diameter at the corners of phosphor layer 10 were as follows:

TABLE 7

| | |
|---|---|
| Horizontal spot diameter $d_H$ | 7.3 [mm] |
| Vertical spot diameter $d_V$ | 3.6 [mm] |

Next, when measurements of the spot diameter were carried out with the distance from rear end surface 51A of the core 51 to the center of gap 40 of the electron gun 30 (L in FIG. 1) set to 31.0 [mm] and the other conditions as set forth above, the following results were obtained, when L/D was 0.62.

TABLE 8

| | |
|---|---|
| Horizontal spot diameter $d_H$ | 7.5 [mm] |
| Vertical spot diameter $d_V$ | 3.0 [mm] |

The fact that the spot diameter in the third embodiment is relatively smaller than that in the second embodiment is due to differences in the electron gun, the anodic voltage and the deflection yoke. That is to say, because of the existence of the aforementioned differences, F(I) in the expression (3) differs from that of the first embodiment.

Note that, in addition to the ordinary S/T-type deflection coil, an auxiliary field generating device in which the coil 55 is wound onto a pair of the E-shaped cores 54, is mounted on the rear end surface 53 of the deflection yoke 50. This is provided to effect the self-convergence, and in it flows a current that is synchronized with the vertical deflection current flowing in vertical deflection coil 52V.

When, in order to examine the fit with expression (3), we adopt a structure that is the same except for the above-described structure and L, with only the position of the electron gun changed so that L=45.0 [mm] (L/D=0.90), the values obtained for horizontal and vertical spot diameter were:

TABLE 9

| | |
|---|---|
| Horizontal spot diameter $d_H$ | 7.6 [mm] |
| Vertical spot diameter $d_V$ | 3.0 [mm] |

The major point of difference between the color CRT device of the third embodiment and one according to conventional art is in the use of a value for L/D that is smaller than the value previously considered to be the lower limit value.

In the third embodiment, the explanation was in terms of examples with L/D values of 0.62 and 0.60.

Under the conditions described above, the color CRT devices according to the conventional art were designed using a lower limit of $$L/D \geq 0.77 \tag{19}$$

obtained by substituting into the expression (2), whereas, in the color CRT device according to the first embodiment, even when the value adopted for L/D was in a range that was inconceivable in the conventional art, namely $$0.46 \leq L/D \leq 0.63 \tag{20}$$

obtained by substituting θ=106° into the expression (15), the effect was obtained that vertical spot diameter was approximately the same as in the conventional art while horizontal spot diameter was better than in the conventional art.

In contrast to the conventional art lower limit value for L/D, taken from the expression (19), which was 0.77, the adoption of the value of 0.63 in a color CRT device according to the third embodiment makes possible a reduction in length of at least $$50 \times (0.77 - 0.63) = 7.0 \text{ [mm]}.$$

In the third embodiment, the explanation was in terms of empirical results for a specific value for the conventional art L/D of 0.90. In the conventional art, an L/D of approximately 0.90 was a sort of standard when the maximum deflection angle θ was 106°.

The overall length reduction effect of this adopted value may thus be represented for an L/D of 0.62 as $$50 \times (0.90 - 0.62) = 14 \text{ [mm]}$$

and for an L/D of 0.60 as $$50 \times (0.90 - 0.60) = 15 \text{ [mm]}$$

This means that, when D is constant, a reduction in length of 14 [mm] when L/D is 0.62, and of 15 [mm] when L/D is 0.60. It is also possible to achieve a spot diameter that is substantially the same as that of the conventional art in the vertical direction, and even smaller than that of the conventional art in the horizontal direction.

Note that in both the second and third embodiments, if the distance L is reduced, the magnetic field distribution required for the deflection yoke 50 changes due to self-convergence and it becomes necessary to fine-tune the distribution of the windings of the deflection coil unit, but that the influence of this tuning on spot diameter is small.

What is claimed is:

1. A color CRT device comprising a cathode ray tube and a deflection coil:

said cathode ray tube comprising:

a panel provided with a phosphor surface which is approximately rectangular, has a diagonal diameter of 45 cm or more, and has an aspect ratio greater than 4/3;

a funnel connected to said panel;

a neck connected to said funnel;

a stem connected to said neck; and an electron gun, which is positioned inside said neck, including a high-voltage electrode, and a focusing electrode which is mounted between said high-voltage electrode and said stem and disposed in proximity to said high-voltage electrode across a gap; and said deflection yoke comprising:

a core which cross-section perpendicular to a tube axis of said cathode ray tube is approximately annular;

a first deflection coil for deflecting in a horizontal direction an electron beam emitted by said electron gun, a winding type of said first deflection coil being a saddle type; and a second deflection coil for deflecting in a vertical direction said electron beam emitted by said electron gun, a winding type of said second deflection coil being a toroidal type;

wherein said color CRT device satisfies a following relational expression:

$$\frac{\sqrt{\frac{1}{1+K^2}}}{\frac{0.113\theta + 0.563}{0.0075\theta - 0.025} - 2.5\sqrt{\frac{1}{1+K^2}}} \leq$$

-continued $$\frac{L}{D} \leqq \frac{\sqrt{\frac{1}{1+K^2}}}{2.0-2.5\sqrt{\frac{1}{1+K^2}}}$$

where

L mm denotes a distance between a central position of said gap and an end surface of said core on a side of said stem, D mm denotes an inner diameter of said core on the side of said stem, θ denotes a maximum deflection angle of said cathode ray tube, and K denotes said aspect ratio.

2. A color CRT device of claim 1, wherein said aspect ratio K is 16/9, and a following relational expression is satisfied:

$$0.003\theta+0.14 \leqq L/D \leqq 0.63.$$

3. A method of manufacturing a color CRT device comprising the steps of:

(a) producing a cathode ray tube, said tube comprising a panel provided with a phosphor surface which is approximately rectangular, has a diagonal diameter of 45 cm or more, and has an aspect ratio greater than 4/3; a funnel connected to said panel; a neck connected to said funnel; a stem connected to said neck; and an electron gun, which is positioned inside said neck, including a high-voltage electrode and, a focusing electrode which is mounted between said high-voltage electrode and said stem and disposed in proximity to said high-voltage electrode across a gap;

(b) forming a deflection yoke, said deflection yoke comprising a core which cross-section perpendicular to a tube axis of said cathode ray tube is approximately annular; a first deflection coil for deflecting in a horizontal direction an electron beam emitted by said electron gun, a winding type of said first deflection coil being a saddle type; and a second deflection coil for deflecting in a vertical direction said electron beam emitted by said electron gun, a winding type of said second deflection coil being a toroidal type; and (c) installing said deflection coil around said neck and said funnel of said cathode ray tube;

wherein said steps (a) to (c) are conducted so as to satisfy a following relational expression:

$$\frac{\sqrt{\frac{1}{1+K^2}}}{\frac{0.113\theta+0.563}{0.0075\theta-0.025}-2.5\sqrt{\frac{1}{1+K^2}}} \leqq \frac{L}{D} \leqq \frac{\sqrt{\frac{1}{1+K^2}}}{2.0-2.5\sqrt{\frac{1}{1+K^2}}}$$

where

L mm denotes a distance between a central position of said gap and an end surface of said core on a side of said stem, D mm denotes an inner diameter of said core on the side of said stem, θ denotes a maximum deflection angle of said cathode ray tube, and K denotes said aspect ratio.

4. A method of claim 3, wherein said aspect ratio K is 16/9, and said steps (a) to (c) are conducted so as to satisfy a following relational expression:

$$0.003\theta+0.14 \leqq \frac{L}{D} \leqq 0.63.$$

* * * * *